United States Patent [19]

Britt et al.

[11] 4,106,765

[45] Aug. 15, 1978

[54] SHEET FEEDING APPARATUS

[75] Inventors: Ronald Howard Britt, Hassocks, England; Jan De Bruin, Bilthoven, Netherlands; David Gordon Boulter, Wivelsfield Green, England

[73] Assignee: U.S. Philips Corporation, New York, N.Y.

[21] Appl. No.: 694,150

[22] Filed: Jun. 9, 1976

Related U.S. Application Data

[62] Division of Ser. No. 584,154, Jun. 5, 1975.

[30] Foreign Application Priority Data

Jun. 13, 1974 [GB] United Kingdom ..... 26259/74

[51] Int. Cl.[2] ..... B65H 3/40

[52] U.S. Cl. ..... 271/93; 271/31; 271/106; 271/153; 271/154; 271/170

[58] Field of Search ..... 271/20, 25, 91, 93, 271/106, 30 R, 152, 153, 154, 169, 170, 3

[56] References Cited

U.S. PATENT DOCUMENTS

| | | | |
|---|---|---|---|
| 2,402,453 | 6/1946 | Schneider | 271/153 |
| 2,434,530 | 1/1948 | Williams | 271/20 |
| 2,869,867 | 1/1959 | Backhouse | 271/93 |

*Primary Examiner*—Richard A. Schacher

*Attorney, Agent, or Firm*—Frank R. Trifari; David R. Treacy

[57] ABSTRACT

An apparatus for feeding sheets of paper or the like in succession from the top of a stack of sheets. A member extending over a corner portion of the stack controls a stack elevator mechanism, and co-operates with a vertically movable suction element which pulls a corner portion of the top sheet from beneath the member so as to feed one sheet at a time.

8 Claims, 15 Drawing Figures

SHEET FEEDING APPARATUS

This is a division of application Ser. No. 584,154, filed Jun. 5, 1975.

BACKGROUND OF THE INVENTION

The invention relates to an apparatus for feeding sheets of paper or the like in succession from the top of a stack of such sheets. More specifically the invention relates to a paper-feeding apparatus in which a transfer device lifts the top sheet at least partially from the stack by suction and then moves this sheet away from the stack, for example, to another stage in the feeding process.

In an apparatus of the above kind it is necessary to effect some degree of separation between the top sheet and the second sheet of the stack before the transfer device lifts the top sheet in order to deter the second sheet from adhering to the top sheet and being lifted with it. If possible, means should be provided for physically holding down the second sheet so that it cannot rise with the top sheet. It is also very desirable to avoid the creation of undulations in the top sheet by the suction of the transfer device when the sheet is attached to the device, since such undulations may lead to crinkling of the paper.

SUMMARY OF THE INVENTION

According to the invention, an apparatus for feeding sheets of paper or the like in succession from the top of a stack of such sheets comprises a vertically movable support for the stack of sheets, a member arranged to extend over a corner portion of the stack, a suction element arranged for downward and upward movement towards and away from the stack on the side of said member remote from the corner of said corner portion of the stack and operable in its upward movement to pull a corner portion of the top sheet of the stack from beneath said member and bring it above this member, the suction element being arranged subsequently to release said corner portion of the top sheet, and a suction transfer device.

In a preferred embodiment according to the invention, the suction transfer device has a substantially flat lower face formed with suction apertures and is movable into a position above the stack in which a portion of said face extends over said corner portion of the stack, the transfer device being operable in this position after the suction element has released the top sheet of the stack, to suck this sheet against the lower face of the transfer device. The arrangement is such that when the transfer device is in said position above the stack and said corner portion of the top sheet is above said member which extends over the corner portion of the stack, said corner portion of the top sheet is closer than any other part of the sheet to the lower face of the transfer device. In the operation of this device first said corner portion of the top sheet is sucked against the lower face of the transfer device and thereafter the area of attachment of the top sheet to said face increases progressively, the transfer device being subsequently operable to move the top sheet away from the stack.

The member which extends over the corner portion of the stack provides a simple and positive means of preventing the second sheet of the stack from being sucked up with the top sheet by the transfer device. It also provides a means of supporting a small portion of the top sheet in a raised position relative to the rest of the sheet so that the attachment of the sheet to the transfer device begins at this small portion and extends gradually over a larger part, or if desired the whole, of the sheet. This progressive attachment of the sheet to the transfer device avoids the creation of undulations in the sheet over the area of attachment.

According to another aspect of the invention the suction element comprises a tube slideable axially upwards and downwards in a fixed sleeve which is in permanent communication at its upper end with a source of vacuum. Across the upper end of the sleeve a wall extends, having an aperture which is spaced from the center of the wall by a distance greater than the outer diameter of the tube, through which aperture the interior of the tube can communicate with the source of vacuum. The tube projects from the lower end of the sleeve so that in the operation of the suction element the top sheet of said stack is sucked against the lower end of the tube. The upper end of the tube can engage the lower surface of said wall to limit the upward movement of the tube and is operable in this engagement to act as a valve member to cut off the interior of the tube from the aperture in said wall. The sleeve has an aperture in its cylindrical wall and the tube has a corresponding aperture which is spaced from the upper end of the tube by a distance equal to the distance between the aperture in the cylindrical wall of the sleeve and the lower surface of the wall across the upper end of the sleeve so that, when the upper end of the tube engages the latter wall, the aperture in the wall of the tube registers with the aperture in the cylindrical wall of the sleeve to open the interior of the tube to atmosphere.

In a further preferred embodiment, the suction transfer device is in the form of a hollow bar having a substantially flat bottom wall in which the suction apertures are formed, the apertures being distributed along the length of the bar. The bar is movable in directions at right angles to its longitudinal axis and is arranged, when in the forward position above the stack, to extend over a portion of the stack which extends along an edge thereof and includes said corner portion of the stack. The transfer bar may be formed with a recess in one side to accommodate the suction element when the bar is in said position above the stack.

In yet another preferred embodiment, the apparatus comprises valve means to connect the transfer device to a source of vacuum when the device is in said position above the stack after the suction element has released the top sheet of the stack.

Timing means for controlling the timing of the operation of the suction element and the operation of the transfer device are preferably arranged so that said corner portion of the top sheet of the stack, after being released by the suction element, is allowed to descend onto the top of said member which extends over the corner portion of the stack before the transfer device operates to suck the top sheet against the lower face of the device.

The transfer device is preferably arranged to be in an upper position above the stack when the suction element releases said corner portion of the top sheet of the stack and to move downwardly from this position to said position above the stack in which the transfer device operates to suck the top sheet against the lower face of the device.

An apparatus according to the invention is very suitable for handling sheets of paper in the size range 14 in.

by 12 in. to 4 in. by 3 in. and the weight range 50 gm/sq.m. to 100 gm./sq.m.

BRIEF DESCRIPTION OF THE DRAWINGS

In order that the invention may be readily carried into effect, an embodiment thereof will now be described by way of example with reference to the accompanying drawings, in which.

DESCRIPTION OF THE PREFERRED EMBODIMENT

Figure 1:
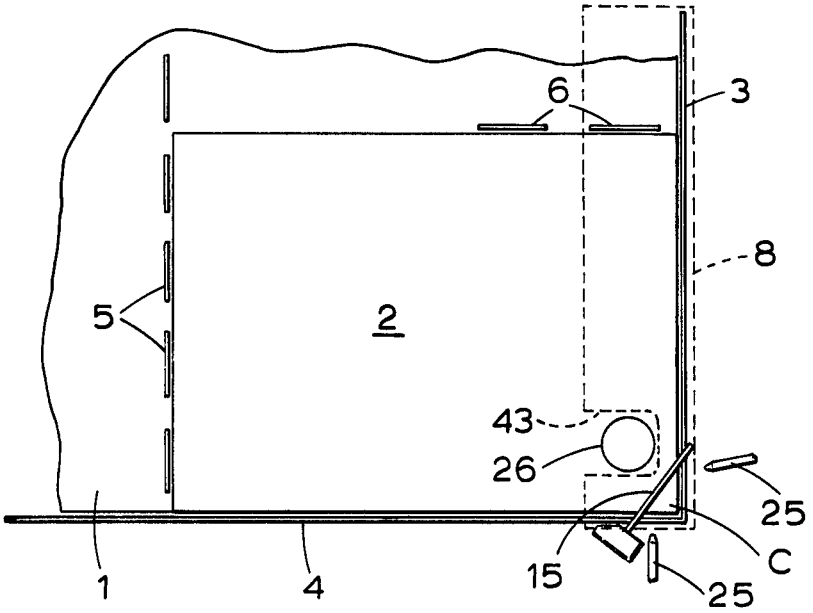
FIGS. 1 and 2 are diagrammatic plan and side views, respectively, of an apparatus constructed in accordance with the invention.
Figure 2:
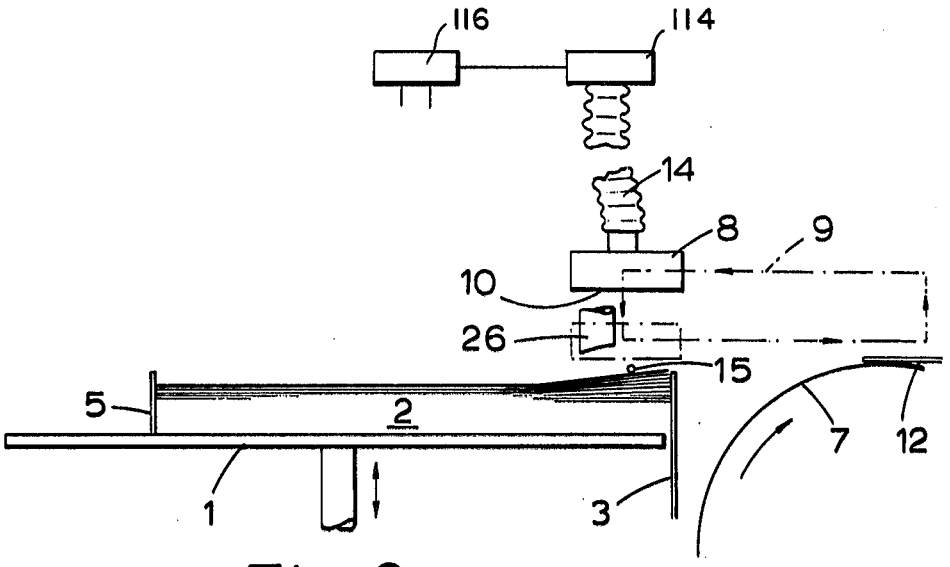
Figure 3:
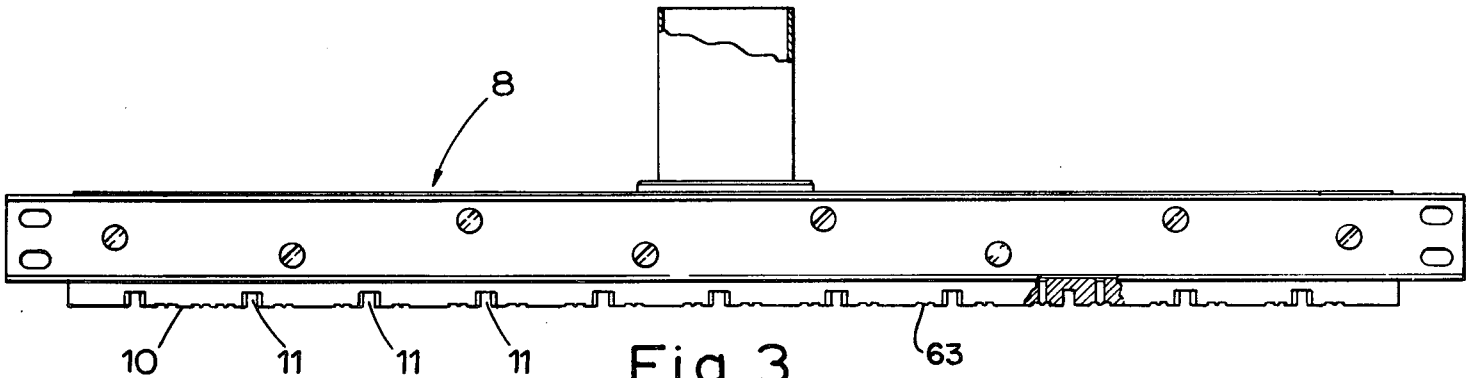
FIGS. 3 and 4 are side and underneath views, repsectively, of the transfer device.

The apparatus shown in FIGS. 1 and 2 comprises a vertically movable table 1 for supporting a stack of sheets of paper or the like. A stack of such sheets is shown at 2. The stack is held in place on the table 1 by four fences including a fixed front fence 3, a fixed side fence 4, a movable back fence 5 and a movable side fence 6. The fences 5 and 6 are movable towards and away from the fixed fences 3 and 4 respectively to accommodate different sizes of sheet. The movable fences 5 and 6 are supported on posts (not shown) slideable in slots (not shown) in the table 1. The fixed fences 3 and 4 are located outside the periphery of the table 1 so that the table can move vertically relative to these fences.

In the particular application of the invention shown the sheets have to be transferred one at a time from the stack 2 to the surface of the rotating drum 7 for further processing. The sheets are held on the surface of the drum by vacuum applied through holes (not shown) in the cylindrical wall of the drum. The drum rotates about an axis extending parallel with the fence 3 and the front edge of the table 1.

Figure 4:
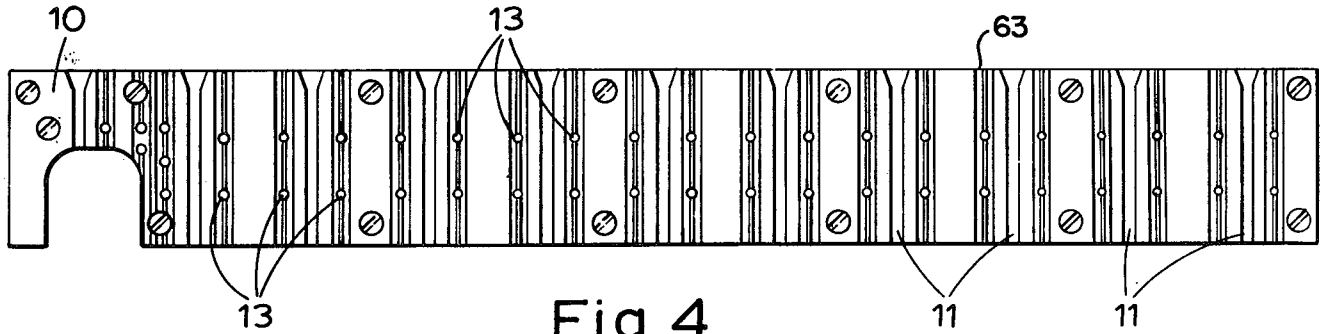

The sheets are transferred from the stack to the drum by a suction transfer device 8 in the form of a hollow bar extending parallel with the axis of the drum. The transfer bar 8 is driven along a closed path in directions at right angles to the longitudinal axis of the bar. This path, which is represented by the broken line 9 in FIG. 2, is defined by a cam mechanism (not shown) of any well-known type, which drives the transfer bar. Other types of mechanism may, of course, be used to drive the transfer bar and define its path of movement. The bar has a rectangular cross-section so that its bottom wall or fare 10 is flat. This fare base transverse grooves 11 (FIG. 4) formed in it to receive stripping fingers 12 (FIG. 2) fixed above the drum 7, but basically the fare 10 is substantially flat. The stripping fingers are provided to strip from the transfer bar a sheet attached thereto by suction, so that this sheet can readily be captured by the drum 7. As shown in FIG. 4, the bottom wall of the transfer bar 8 is formed with two rows of suction apertures 13 and shallow suction distribution grooves 63 communicating therewith. The transfer bar is connected to a source of vacuum (not shown) by a flexible hose 14. Communication between the transfer bar and the vacuum source is controlled by an electrically actuated butterfly-valve 114 shown schematically.

Figure 5:
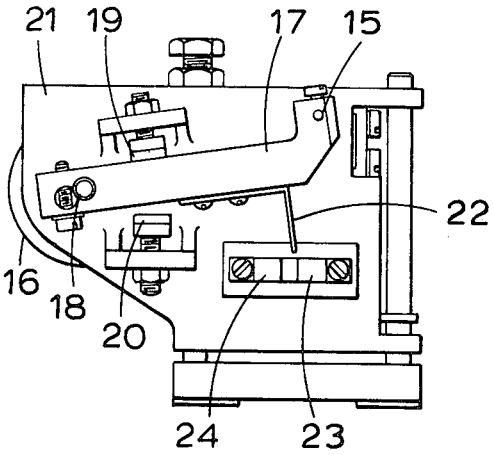
FIGS. 5 and 6 are side and plan views, respectively, of a device for sensing the level of the top of the stack and comprising a movable wire which also serves in a raised position as the member which extends over the corner portion of the stack.
Figure 6:
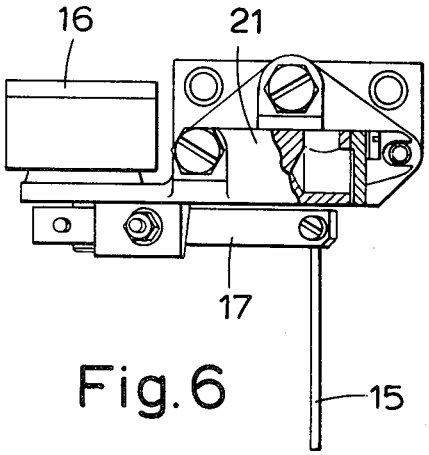

Extending horizontally and obliquely over one of the front corner portions of the stack of sheets 2, i.e. one of the corner portions adjacent the front fence 3, is a rigid wire 15 whose main function is to support a corner portion of the top sheet of the stack 2 in a raised position relative to the remainder of the sheet for a purpose to be described later herein. The wire 15 has a predetermined position for this function, in which position the underside of the wire is approximately level with the top of the front fence 3. The wire is movable below this position to perform an additional function, namely that of controlling a stepping motor (not shown) for raising the table 1 so that the top of the stack 2 is maintained within a predetermined distance, for example 5mm, from the predetermined position of the wire 15 as the sheets are removed from the top of the stack during the operation of the apparatus. The wire is held in the predetermined position by a rotary solenoid 16 (FIGS. 5 and 6) which is energized and de-energized under the control of a timing system 116, shown generally which controls the cycle of operations of the apparatus, as will be hereinafter described. The wire 15 is carried by a lever 17 which is fixed on the armature shaft 18 of the solenoid 16 and which is pivotable in a vertical plane between adjustable stops 19 and 20 mounted on a fixed bracket 21 which also supports the solenoid 16. FIG. 5 shows the wire 15 held by the energized solenoid in the predetermined upper position, which is fixed by the upper stop 19. When the solenoid is de-energised, which occurs at every removal of a sheet from the top of the stack 2, the wire 15 falls under the weight of the lever 17, which may be of the order of 20gms. The wire drops onto the top of the stack 2, and if in so doing its falls through more than the predetermined distance of 5mm., a blade 22 (FIG. 5) fixed on the underside of the lever 17 and projecting downwardly therefrom interrupts a light beam travelling between a light-emitting diode and a photo-transistor encapsulated in blocks 23 and 24 respectively mounted on the bracket 21. This brings the stepping motor into operation to raise the table 1. When the top of the stack reaches a level 5mm. below the upper position of the wire 15, the wire, which has risen with the stack and so raised the lever 17, withdraws the blade 22 from the path of the light beam between the diode and the transister in the blocks 23 and 24. After a predetermined period of de-energization the solenoid 16 is energized to raise the wire 15 to its upper position again.

The front and side fences 3 and 4 are slotted to accommodate the movement of the wire 15. They are also formed with openings to permit two riffling jets 25 (FIG. 1) to blow air into the edges of the upper part of the stack 2 at the corner portion thereof over which the wire 15 extends. This corner portion is designated C in FIG. 1. The local expansion of the stack caused by the riffling is limited by the wire 15 to a maximum of 5 mm., this being the predetermined maximum distance permitted in the present example between the top of the stack and the wire 15 in the upper position of the wire, as already described.

Figure 7:
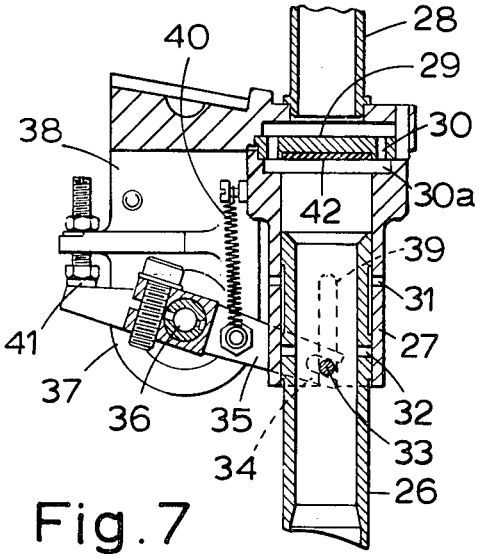
FIGS. 7 and 8 are sectional side views of the suction element at the lower and upper limits respectively, of its downward and upward movement.
Figure 8:
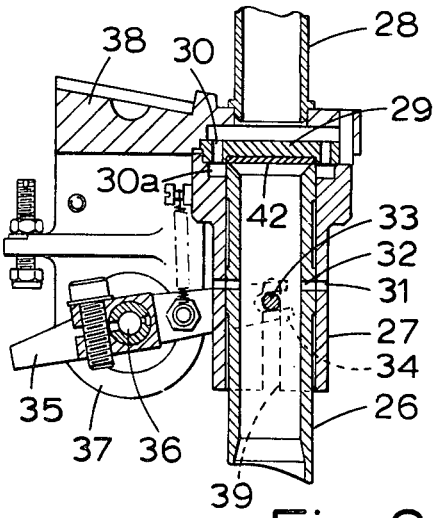

Arranged above the stack 2 is a vertically movable suction tube 26 which is shown in detail in FIGS. 7 and 8. The distance between the longitudinal axis of the tube 26 and the wire 15, measured horizontally, may be in the region of 20 to 25 mm., for example. The tube 26, which has an outer diameter of approximately 20 mm., for example, is slideable axially in a fixed vertical sleeve 27 which at its upper end is in permanent communication with a source of vacuum (not shown) through a pipe 28. The tube 26 projects from the lower end of the sleeve 27. Extending across the upper end of the sleeve is a wall 29 which is formed with a plurality of apertures 30 arranged in a circle having a diameter greater than the outer diameter of the suction tube 26. The apertures 30 communicate on one side of the wall 29 with the pipe 28 and on the other side with the interior of the sleeve 27 below the wall 29 via an annular recess 30*a* in the cylindrical wall of the sleeve. In this wall of the sleeve is a series of aperatures 31 which are distributed around the wall of the sleeve in a plane at right angles to the wall of the sleeve. A corresponding series of apertures 32 is formed in the wall of the suction tube 26 at a distance from the upper end of the tube equal to the distance between the apertures 31 in the sleeve 27 and the lower surface of the wall 29 across the upper end of the sleeve. Extending diametrically through the suction tube 26 and fixed in the wall thereof is a pin 33 which projects beyond the wall of the tube to engage in the forked end 34 of a lever 35 fixed on the armature shaft 36 of a rotary solenoid 37. The solenoid 37 and the sleeve 27 are supported by a fixed mounting 38. The pin 33 is slideably guided in an axially extending slot 39 in the cylindrical wall of the sleeve 27. This prevents any rotational movement of the suction tube 26 relative to the sleeve 27.

The suction tube 26 is movable vertically in the sleeve 27 through a distance of some 20mm., for example, between a lower position as shown in FIG. 7 and an upper position as shown in FIG. 8. In the lower position the interior of the tube 26 communicates with the vacuum source via the interior of the sleeve 27, the apertures 30 in the wall 29 across the upper end of the sleeve, and the pipe 28. The tube 26 is lowered by the armature 37 against the resistance of a spring 40 acting on the lever 35. The lower position of the suction tube is determined by an adjustable stop 41 against which the lever 35 abuts. The tube 26 is raised by the spring 40 and by the suction in the tube acting on the top sheet of the stack 2 when this sheet has been sucked against the lower end of the tube during the operation of the tube, as will be explained later herein. The tube 26 rises until its upper end abuts the wall 29 across the upper end of the sleeve 27, which wall thus determines the upper position of the suction tube. In engaging the wall 29, which is provided with a layer 42 of resilient material on its lower surface, the upper end of the suction tube 26 acts as a valve member to cut off the interior of the tube from the apertures 30 in the wall 29 and thus interrupt the communication between the interior of the tube and the vacuum source. Simultaneously, the apertures 32 in the wall of the suction tube register with the apertures 31 in the cylindrical wall of the sleeve 27 to open the interior of the suction tube to the atmosphere so that the sheet of paper sucked against the lower end of the tube is released. The suction tube is held in the upper position by the spring 40 until the next operation of the armature 37.

The cycle of operations of the above apparatus will now be described. The sequence of these operations and their timing is mostly controlled by a timing system 116, shown schematically, which comprises a clock driven by the mechanism which drives the transfer bar 8. In FIG. 2 the transfer bar is shown in an upper position above the front edge portion of the stack of sheets 2. In this position the bottom wall 10 of the transfer bar is spaced some 25 mm., for example, above the upper position of the wire 15. The transfer bar is made long enough to extend over the whole length of the front edge portion of the stack; hence the length of the bar is at least equal to the relevant dimension of the largest sheet which the apparatus is designed to handle. In this upper position of the transfer bar 8 the butterfly valve 14 in the vacuum connection to the bar is closed so that there is no suction in the bar. The transfer bar remains stationary in the upper position while the suction tube 26 descends, the tube, and its supporting sleeve 27, being accommodated in a recess 43 in the transfer bar. Under the control of the timing clock the solenoid 37 has been energized to lower the suction tube and the riffling jets 25 have been switched on. FIG. 2 shows the tube 26 descending and the upper part of the corner portion C of the stack 2 being riffled by the jets 25. The riffling causes a local separation of the top few sheets of the stack and, as shown in FIG. 2, holds the top sheet against the underside of the wire 15, which at this stage is held in its upper position by the solenoid 16.

Figure 9A:
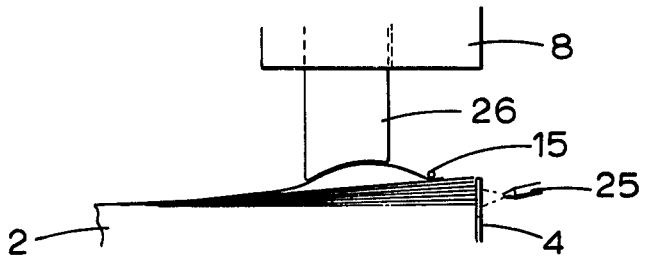
FIGS. 9*a* to 9*e* are diagrammatic views illustrating a number of successive stages in the operation of the suction element and the transfer device.
Figure 9B:
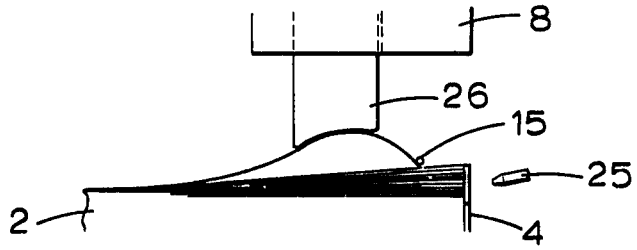
Figure 9C:
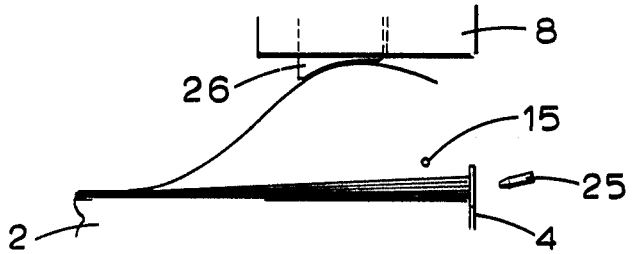

As can be seen from FIGS. 7 and 8, as the suction tube 26 begins its downward movement the upper end of the tube becomes unseated from the lower surface of the wall 29 across the upper end of the sleeve 27 so that the interior of the suction tube is placed in communication with the vacuum source through the apertures 30 in the wall 29. At the same time the apertures 32 in the wall of the suction tube are moved out of register with the apertures 31 in the cylindrical wall of the sleeve 27, thus cutting off the interior of the suction tube from the atmosphere. When the lower end of the suction tube 26 reaches approximately the level of the wire 15 (in its upper position) the suction in the tube draws the top sheet of the stack 2 against the lower end of the tube, as shown in FIG. 9*a*. As can be seen in the drawing, the edge of the suction tube 26 at the lower end thereof is concavely curved to follow the surface of an imaginary cylinder so that the sheet can bend locally in a smooth curve as it is sucked against the lower end of the tube. The solenoid 37 is then de-energized to allow the suction tube 26 to rise and the riffling jets 25 are switched off. As the tube rises it draws with it the part of the top sheet that is sucked against the lower end of the tube, as shown in FIG. 9*b*, with the result that the corner portion of the sheet over which the wire 15 extends is pulled from beneath the wire. FIG. 9*c* shows the corner portion of the top sheet well clear of the wire 15 with the suction tube 26 at the top of its stroke. When the suction tube reaches this position it performs the valve action described earlier herein to cut off the interior of the tube from the vacuum source and place it in communication with atmosphere so that the sheet is released from the tube to fall down onto the top of the wire 15. The corner portion of the top sheet is now supported by the wire in a raised position relative to the remainder of the sheet.

Figure 9D:
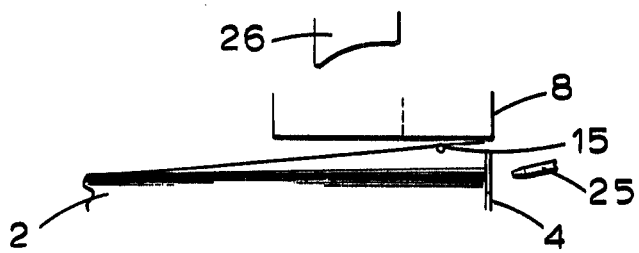

When the suction tube reaches its upper position and the top sheet has been released from the tube, the transfer bar 8 moves down, to a pick-up position in which the bottom fare 10 of the bar is about 2mm. above the wire 15, as shown in FIG. 9*d*. If the top sheet falls too slowly onto the wire 15 the transfer bar, as it moves down, will push the sheet before it. A rotary solenoid (not shown) is then energised to open the butterfly valve 114 in the vacuum connection to the transfer bar 8 so that vacuum is rapidly switched into the bar. The vacuum source may be arranged to draw air through the bar at about 50cfm, for example. Since the corner portion of the top sheet that is resting on the wire 15 is closer to the transfer bar than any other part of the sheet, this corner portion will be sucked up first against the bottom fare 10 of the bar, followed by the remainder of the front edge portion of the sheet. Due to the distribution of the suction apertures 13 along the bottom fare of the transfer bar, the attachment of the sheet to the bar will take place progressively and smoothly. This progressive attachment, in which the area of contact between the sheet and the bottom fare of the transfer bar gradually expands along the bar and the front edge portion of the sheet, can be likened to the way in which wallpaper is brushed onto a wall in paper-hanging.

After a predetermined period which allows the attachment of the front edge portion of the top sheet to the transfer bar 8 to be completed, the transfer bar moves forward horizontally over the front fence 3 towards the drum 7, drawing the top sheet with it, as shown in FIG. 9*c*. When the transfer bar reaches the drum 7 the sheet is sucked against the surface of the drum by the vacuum in the drum and the stripping fingers 12 enter the grooves 11 in the bottom fare 10 of the transfer bar. At the same time the solenoid which actuates the butterfly valve 114 in the vacuum connection to the transfer bar is de-energized so that the valve closes to cut off the interior of the bar from the vacuum source. The transfer bar then rises, leaving the sheet adhering to the surface of the rotating drum 7. The stripping fingers 12 overcome any tendency of the sheet to rise with the transfer bar. After a predetermined upward travel the transfer bar moves back to its upper position above the front edge portion of the stack of sheets 2 on the table 1.

Figure 9E:
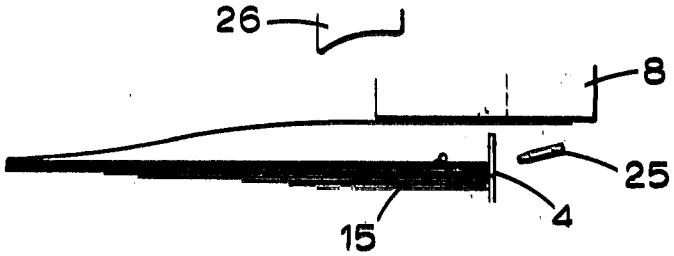

During the attachment of the top sheet of the stack to the transfer bar 8, as soon as the corner portion of the sheet has been sucked against the bottom fare of the transfer bar and no longer requires support by the wire 15, the solenoid 16 (FIGS. 5 and 6) is de-energized to allow the wire 15 to fall onto the second sheet of the stack 2, as shown in FIG. 9*e*, and carry out its height-sensing function. This is the function described earlier herein whereby, as the reduction in the height of the stack 2 due to the removal of the sheets brings the top of the stack below the prescribed level relative to the upper position of the wire 15, the stepping motor is brought into operation to raise the table 1 and bring the top of the stack to the prescribed level again.

Figure 10:
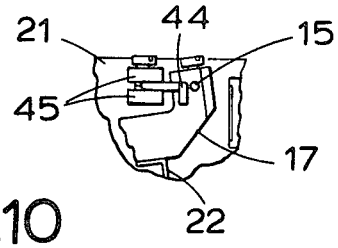
FIGS. 10 and 11 are fragmentary side and plan views, respectively, of a modification of the device shown in FIGS. 5 and 6.
Figure 11:
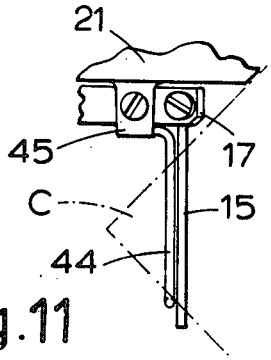

FIGS. 10 and 11 show a modification in which the wire 15 is used solely for the height-sensing function and a second, fixed wire 44 is provided for supporting the corner portion of the top sheet of the stack in the raised position for the attachment of the sheet to the transfer bar 8. This fixed wire is clamped rigidly at one end between two lugs 45 on the bracket 21 and extends alongside the movable wire 15 when the latter is in its upper position. The provision of the second wire 44 has the advantage that the wire 15 does not have to wait in the upper position ready to support the corner portion of the top sheet while the transfer bar 8 descends to pick up this sheet; it can come into operation to perform its height-sensing function as soon as the suction tube 26 has pulled the top sheet from beneath the two wires 15 and 44 and the riffling jets 25 have been switched off. In place of a second wire a triangular plate may be fixed to the top of the fences 3 and 4 so as to extend over the corner portion C of the stack 2 with the oblique edge of the plate lying alongside the wire 15 when the latter is in its upper position.

When the fixed wire 44 is provided, the wire 15 does not have to be located over the corner portion C of the stack 2; it may operate at any point on the stack. Furthermore, it may be replaced by a height-sensing device of any other suitable construction.

If desired, the riffling jets 25 may be left on permanently while the apparatus is in operation provided the weight which lowers the wire 15, namely, the weight of the lever 17 in the embodiment shown, is sufficient to overcome the separating force exerted on the sheets by the riffling jets so that the wire can compress the riffled sheets and sink to the level of the top of the stack.

Other modifications can be made without departing from the scope of the invention. For example, the sleeve 27 can be arranged to support the suction tube 26 with a slight inclination towards the center of the stack 2 at its upper end so as to mitigate any tendency of the suction tube as it rises with a sheet adhering to it to pull the sheet horizontally out of position. Also, the table 1 can be inclined downwards slightly, for example, about 2° from the side at which the fence 4 is located to the opposite side so as to ensure that the progressive character of the attachment of the sheets to the transfer bar 8 is preserved when large sheets are being handled by the apparatus and they become curved.

What is claimed is:

1. An apparatus for feeding a sheet of material from the top of a stack of such sheets, comprising:

first suction means for pulling a corner portion of a top sheet of a stack upwards;

means for mounting said first suction means for movement between a lower position in which said suction means is disposed to suck against a portion of the top sheet at a location a given distance from the corner of the sheet, and an upper position;

means for determining when the top of the stack of sheets has fallen below a predetermined level, said determining means comprising a rigid member extending horizontally over said corner portion of the stack between said location and said corner; and actuator means for moving said member upwards to a predetermined raised position, and downwards to contact the top sheet;

means operable while said rigid member is in the raised position for moving said first suction means from said lower position to said upper position so as to pull a corner portion of the top sheet from beneath said rigid member and bringing said sheet to a position above said rigid member; and second suction means for transferring the top sheet away from the stack.

2. An apparatus as claimed in claim 1, wherein said actuator means comprises a lever pivoted about a horizontal axis for movement of said rigid member between said raised position and downwards to contact the top sheet, said member remaining parallel to said axis.

3. An apparatus as claimed in claim 2, wherein energization of said actuator means moves the rigid member to the raised position, de-energization of the actuator allowing movement of the rigid element under the force of gravity so as to make line contact with the top sheet.

4. An apparatus as claimed in claim 2, wherein said means for moving said first suction means includes means for releasing suction when said first suction means has reached said upper position so as to allow said sheet to fall; and in said upper position said first suction means is so disposed that said corner portion will fall onto said rigid member.

5. An apparatus for feeding a sheet of material from the top of a stack of such sheets, comprising:

a vertically movable support for a stack of sheets;

first suction means for pulling a corner portion of the top sheet of the stack upwards;

means for determining when the top of the stack has fallen below a predetermined level, said level-determining means comprising a rigid member which can move up and down and which is arranged to extend horizontally over said corner portion of the stack between said location and said corner and obliquely with respect to the edges of the stack, and actuator means for controllably holding said rigid member in a predetermined raised position and allowing said member to move downwards to contact the top sheet;

means for mounting and moving said first suction means from a lower position in which said suction means is disposed to suck against a portion of the top sheet at a location a given distance from the corner of the sheet to an upper position so as to pull said corner portion of the top sheet from beneath said rigid member and bring it above this member;

means for causing said first suction means to release said corner portion when said first suction means is in the upper position, in said upper position said first suction means being so arranged as to allow the top sheet to fall onto the top surface of said rigid member and be supported thereby when said member is in the raised position;

second suction means for transferring to top sheet away from the stack, said second suction means comprising a transfer bar having a lower face formed with suction apertures and so arranged that a portion of said face extends over said corner portion of the stack when said bar is in a predetermined pick-up position, in which position said face is closer to said corner portion of the top sheet, when this portion has been pulled from beneath said rigid member by said first suction means and allowed to fall onto said member, than to any other part of the top sheet, such that upon application of suction through said suction apertures first first said corner portion of top sheet is sucked against the lower face of the transfer bar and thereafter the area of attachment of the top sheet to said face increases progressively;

and timing means for controlling the sequence of operations of the apparatus, said timing means including means for delaying application of vacuum to the transfer bar for a predetermined period of time to allow said corner portion of the top sheet to descend to the top surface of said rigid member when released by the first suction means, and for controlling said actuator such that the member is held in the predetermined raised position before the application of vacuum to the transfer bar and allowed to move downward only after the transfer bar has reached the pick-up position and suction has been applied to the transfer bar.

6. An apparatus as claimed in claim 5, comprising in addition means under the control of said timing means for moving the transfer bar between the pick-up position, a transfer position and an upper position above the stack and maintaining the bar in the latter position while the first suction means is moving to pull said corner position of the top sheet from beneath said rigid member.

7. An apparatus as claimed in claim 5, wherein said rigid member is mounted on a horizontally pivoted lever and is arranged to be raised by energization of the actuator, and to move downwards under the force of gravity upon de-energization of the actuator.

8. An apparatus as claimed in claim 7, comprising in addition a riffling jet for blowing air against the edge of the upper part of the stack at said corner portion, operation of said riffling jet being controlled by said timing means such that the jet is turned on after energization of the actuator, and is stopped after the top sheet of the stack has been sucked against said first suction means.

* * * * *

UNITED STATES PATENT OFFICE

CERTIFICATE OF CORRECTION

Patent No. 4,106,765 Dated August 15,1978

Inventor(s) Ronald Howard Britt et al

It is certified that error appears in the above-identified patent and that said Letters Patent are hereby corrected as shown below:

Col. 9, line 40, After "transferring" delete "to" and insert -- the --

Col. 10, line 7, After "apertures" delete "first" (first occurrence)

Col. 10, line 8, After "of" insert -- the --

Col. 10, line 31, Before "of" change "position" to -- portion --

Signed and Sealed this

Third Day of March 1981

[SEAL]

Attest:

RENE D. TEGTMEYER

Attesting Officer

Acting Commissioner of Patents and Trademarks